US009164453B2

(12) United States Patent
Kotera

(10) Patent No.: US 9,164,453 B2
(45) Date of Patent: Oct. 20, 2015

(54) IMAGE FORMING APPARATUS AND POST-PROCESSING DEVICE

(75) Inventor: Shinichi Kotera, Osaka (JP)

(73) Assignee: KYOCERA DOCUMENT SOLUTIONS INC., Osaka-Shi (JP)

( * ) Notice: Subject to any disclaimer, the term of this patent is extended or adjusted under 35 U.S.C. 154(b) by 540 days.

(21) Appl. No.: 13/308,225

(22) Filed: Nov. 30, 2011

(65) Prior Publication Data

US 2012/0134728 A1 May 31, 2012

(30) Foreign Application Priority Data

Nov. 30, 2010 (JP) ..... 2010-267773

(51) Int. Cl.
*G03G 21/16* (2006.01)
*G03G 15/00* (2006.01)

(52) U.S. Cl.
CPC ..... *G03G 15/5004* (2013.01); *G03G 15/80* (2013.01); *G03G 2215/00417* (2013.01); *G03G 2215/00426* (2013.01)

(58) Field of Classification Search
CPC ..... G03G 15/80; G03G 2221/166; G03G 2215/00978; G03G 21/1652; G03G 2215/00417; G03G 2215/00421; G03G 2215/00426; B65H 2515/70; B65H 2515/702; B65H 2515/706
USPC ..... 399/37, 88, 90, 407–411
See application file for complete search history.

(56) References Cited

U.S. PATENT DOCUMENTS

| | | | | |
|---|---|---|---|---|
| 7,298,987 | B2 * | 11/2007 | Tokishige et al. | 399/107 |
| 2002/0168197 | A1 * | 11/2002 | Kitozaki | 399/88 |
| 2004/0183246 | A1 * | 9/2004 | Jung et al. | 270/37 |
| 2005/0063726 | A1 * | 3/2005 | Kinouchi et al. | 399/88 |
| 2009/0035007 | A1 * | 2/2009 | Eom | 399/88 |
| 2012/0044530 | A1 * | 2/2012 | Kato et al. | 358/1.15 |

FOREIGN PATENT DOCUMENTS

| | | | | |
|---|---|---|---|---|
| JP | 2001-13751 A | | 1/2001 | |
| JP | 2002-278194 A | | 9/2002 | |
| JP | 2002252907 A | * | 9/2002 | G03G 15/00 |
| JP | 2010-085431 A | | 4/2010 | |

OTHER PUBLICATIONS

Office Action mailed Mar. 26, 2013 in corresponding Japanese Application No. 2010-267773.

* cited by examiner

*Primary Examiner* — Daniel J Colilla
*Assistant Examiner* — Ruben Parco, Jr.
(74) *Attorney, Agent, or Firm* — Knobbe Martens Olson & Bear LLP

(57) ABSTRACT

A copy machine 1 is provided with: a main body device includes a main body ejection portion that ejects a target material on which an image is formed; and a post-processing device that performs predetermined post-processing on the target material that is fed to a post-processing unit inlet. The post-processing device is provided with a transformation unit that transforms a voltage of power supplied from a main power supply unit inside the main body device to a voltage required for driving of the post-processing device.

11 Claims, 10 Drawing Sheets

IMAGE FORMING APPARATUS AND POST-PROCESSING DEVICE

This application is based on and claims the benefit of priority from Japanese Patent Application No. 2010-267773, filed on 30 Nov. 2010, the content of which is incorporated herein by reference.

BACKGROUND OF THE DISCLOSURE

1. Field of the Disclosure

The present Disclosure relates to an image forming apparatus and a post-processing device.

2. Related Art

Conventionally, an image forming apparatus is known that includes a post-processing device in addition to an image forming main body device.

Such an image forming apparatus is configured by connecting a post-processing unit as a (optional) post-processing device to the image forming main body device.

In addition, depending on a position of the paper ejection portion formed in the image forming main body device, the image forming apparatus may have a relay unit that connects between the paper ejection portion and the post-processing unit (Related Art 1).

However, in Related Art 1, the relay unit and the post-processing unit are supplied with power from the image forming main body device.

In this case, the image forming main body device must have a power supply unit for supplying power to a driving unit such as motor included in the relay unit and the post-processing unit.

Here, since the relay unit and the post-processing unit are optional, these are not necessarily connected to the image forming main body device.

As a result, if the power processing unit for supplying power to optional devices is disposed in the image forming main body device, the price of the image forming main body device may be unnecessarily high.

SUMMARY OF THE DISCLOSURE

An objective of the present disclosure is to provide an image forming apparatus having an image forming main body device and a post-processing device, in which a power unit for supplying power necessary for driving the post-processing device is provided separately from the image forming main body device. Another objective of the present invention is to provide an optional device having a power unit for supplying power necessary for driving the post-processing device.

The present disclosure relates to an image forming apparatus including: a main body device that forms an image on a target material, the main body device including a case member that constitutes an outer shape thereof, a storage unit that stores the target material and is attached to the case member so as to be insertable and removable, a main power supply unit to which power of a first voltage supplied from an external power source is input and which can output power of the first voltage, an image forming unit that is driven by the power supplied from the main power supply unit and that forms an image on the target material, a main body ejection portion that ejects the target material on which the image is formed by the image forming unit, to the outside of the case member, and a main body feeder that feeds the target material stored in the storage unit to the image forming unit and feeds the target material on which the image is formed by the image forming unit to the main body ejection portion, and a post-processing device attached to the main body device, the post-processing device including a supporting unit that is connected to the main body device, a power unit attached to the supporting unit and supplied with the power of the first voltage from the main power supply unit, the power unit outputting the power thus supplied after a transformation process to a second voltage, and a post-processing unit attached to the supporting unit so as to be attachable and removable, that performs a predetermined post-process on the target material ejected from the main body ejection portion.

The present disclosure relates to a post-processing device in an image forming apparatus, the image forming apparatus including: a main body device that forms an image on a target material, the main body device including a case member that constitutes an outer shape thereof, a storage unit that stores the target material and is attached to the case member so as to be insertable and removable, a main power supply unit to which power of a first voltage supplied from an external power source is input and which can output power of the first voltage, an image forming unit that is driven by the power supplied from the main power supply unit and that forms an image on the target material, a main body ejection portion that ejects the target material on which the image is formed by the image forming unit, to the outside of the case member, and a main body feeder that feeds the target material stored in the storage unit to the image forming unit and feeds the target material on which the image is formed by the image forming unit to the main body ejection portion; and the post-processing device being attached to the main body device, in an image forming apparatus, the post-processing device including a supporting unit that is connected to the main body device, a power unit attached to the supporting unit and supplied with the power of the first voltage from the main power supply unit, the power unit outputting the power thus supplied after a transformation process to a second voltage, and a post-processing unit attached to the supporting unit so as to be attachable and removable, that performs a predetermined post-process on the target material ejected from the main body ejection portion.

DETAILED DESCRIPTION OF THE DISCLOSURE

Embodiments of the image forming apparatus according to the present disclosure are described hereinafter with reference to the drawings.

Figure 1:
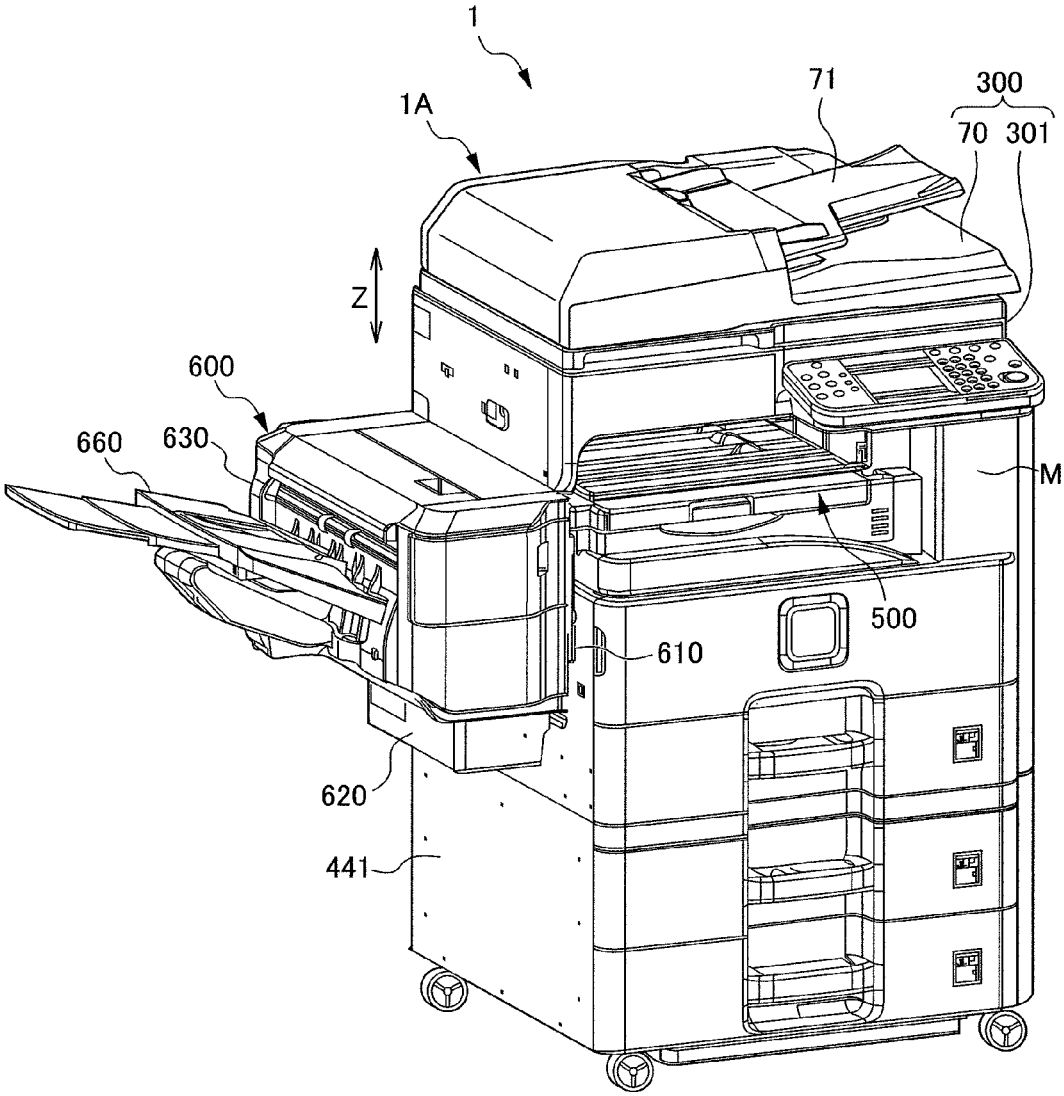
FIG. 1 is a perspective view of an external appearance of a copy machine 1 as an embodiment of the image forming apparatus of the present disclosure.

FIG. 1 is a perspective view of an external appearance of a copy machine 1 as an embodiment of the image forming apparatus of the present disclosure.

Figure 2:
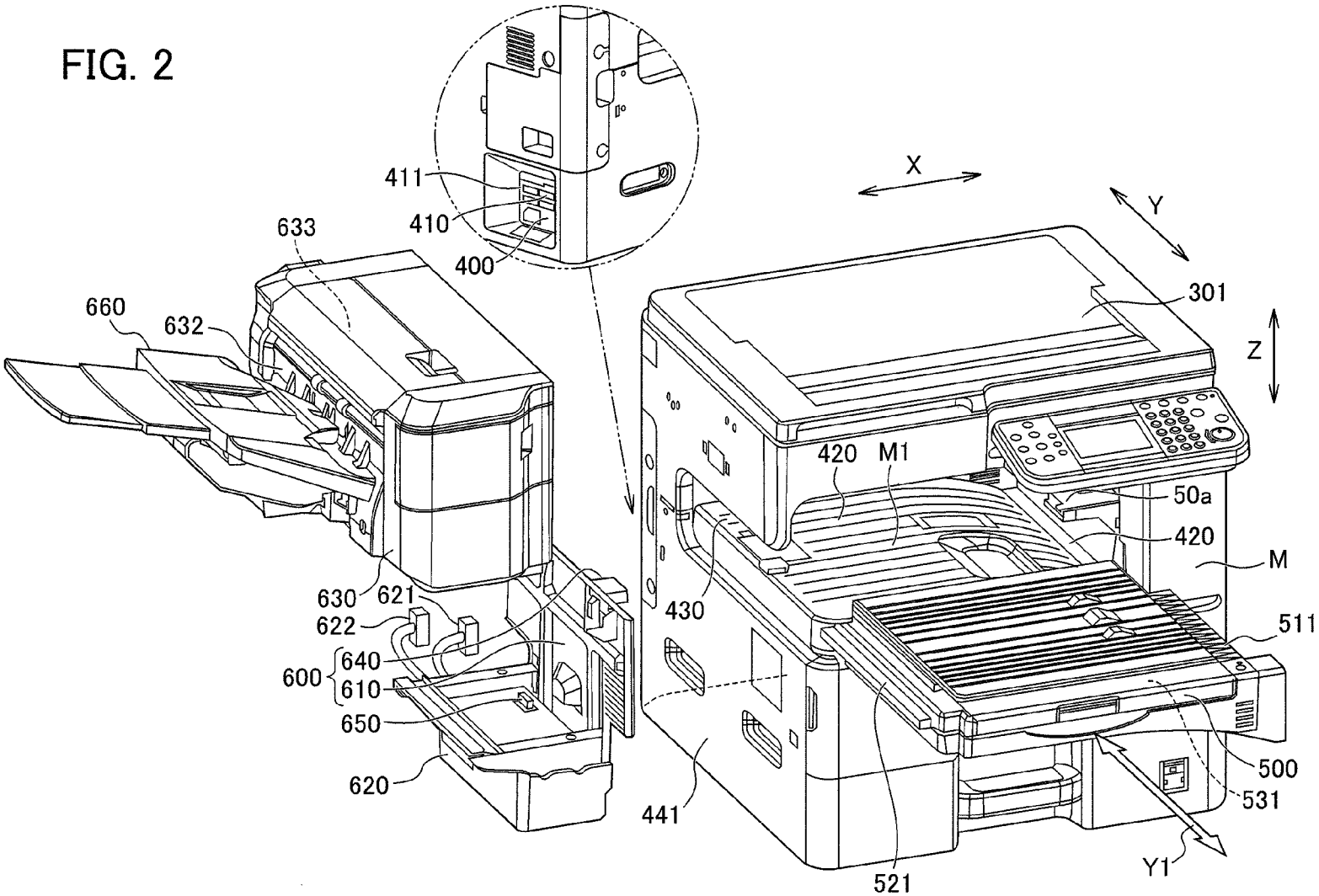
FIG. 2 is an exploded perspective view of a main body device M that constitutes the copy machine 1 shown in FIG. 1, and a relay unit, a supporting unit, a power unit and a post-processing unit that are optionally attached as a post-processing device.

FIG. 2 is an exploded perspective view of a main body device M that constitutes the copy machine 1 shown in FIG. 1, and a relay unit, a supporting unit, a power unit and a post-processing unit that are optionally attached as a post-processing device.

A portion encircled by a dotted line in FIG. 2 shows a main power supply unit 400 and a first voltage output connector 410 that are disposed on a back face side of the copy machine 1.

As shown in FIGS. 1 and 2, the copy machine 1 as an embodiment of the present disclosure is provided with: a main body device M; an image reading device 300 attached to an upper portion of the main body device M; a relay unit 500 attached to the main body device M; a supporting unit 600 attached to the main body device M; and a power unit 602 and a post-processing unit 630 that are attached to the supporting unit 600.

Here, as shown in FIG. 2, the relay unit 500, the supporting unit 600, the power unit 620 and the post-processing unit 630 are optionally attached to the main body device M.

In the present embodiment, the post-processing device includes the relay unit 500, the supporting unit 600, the power unit 620 and the post-processing unit 630.

In addition, as shown in FIG. 2, the main body device M includes a main power supply unit 400 that is embedded on a back face side of a left lateral face thereof.

The main power supply unit 400 is connected to an external power source, is supplied with power of a first voltage, performs a transformation process and the like, and feeds power to various driving units and the image reading device 300 that are provided by standard in the main body device M.

The main power supply unit 400 also includes a first voltage output connector 410 that can supply power of the first voltage from the external power source to the power unit 620.

The power unit 620 (described later) transforms the power supplied from the first voltage output connector 410 and supplies the power thus transformed to the relay unit 500 and the post-processing unit 630 that are optionally provided in the main body device M.

Configuration of the relay unit 500, the supporting unit 600, the power unit 620 and the post-processing unit 630, and power supply to the relay unit 500 and the post-processing unit 630 are described in detail after a description of the main body device M.

As shown in FIG. 1, the image reading apparatus 300 is disposed in an upper end portion of the copy machine 1 in a perpendicular direction Z.

The image reading apparatus 300 reads an image of an original and outputs image information, which is information relating to the image thus read, to the main body device M (image forming unit).

The main body device M forms a toner image on paper T, as a sheet-shaped material, based on the image information transmitted from the image reading device 300.

It should be noted that, in a description of the copy machine 1, a sub-scanning direction X shown in FIG. 2 is also referred to as "lateral direction" and a main scanning direction Y orthogonal to the sub-scanning direction X (see FIG. 2) is also referred to as "depth direction" of the copy machine 1.

The perpendicular direction Z of the copy machine 1 is orthogonal to the sub-scanning direction X and the main scanning direction Y.

Firstly, the image reading apparatus 300 will be described with reference to FIG. 3.

Figure 3:
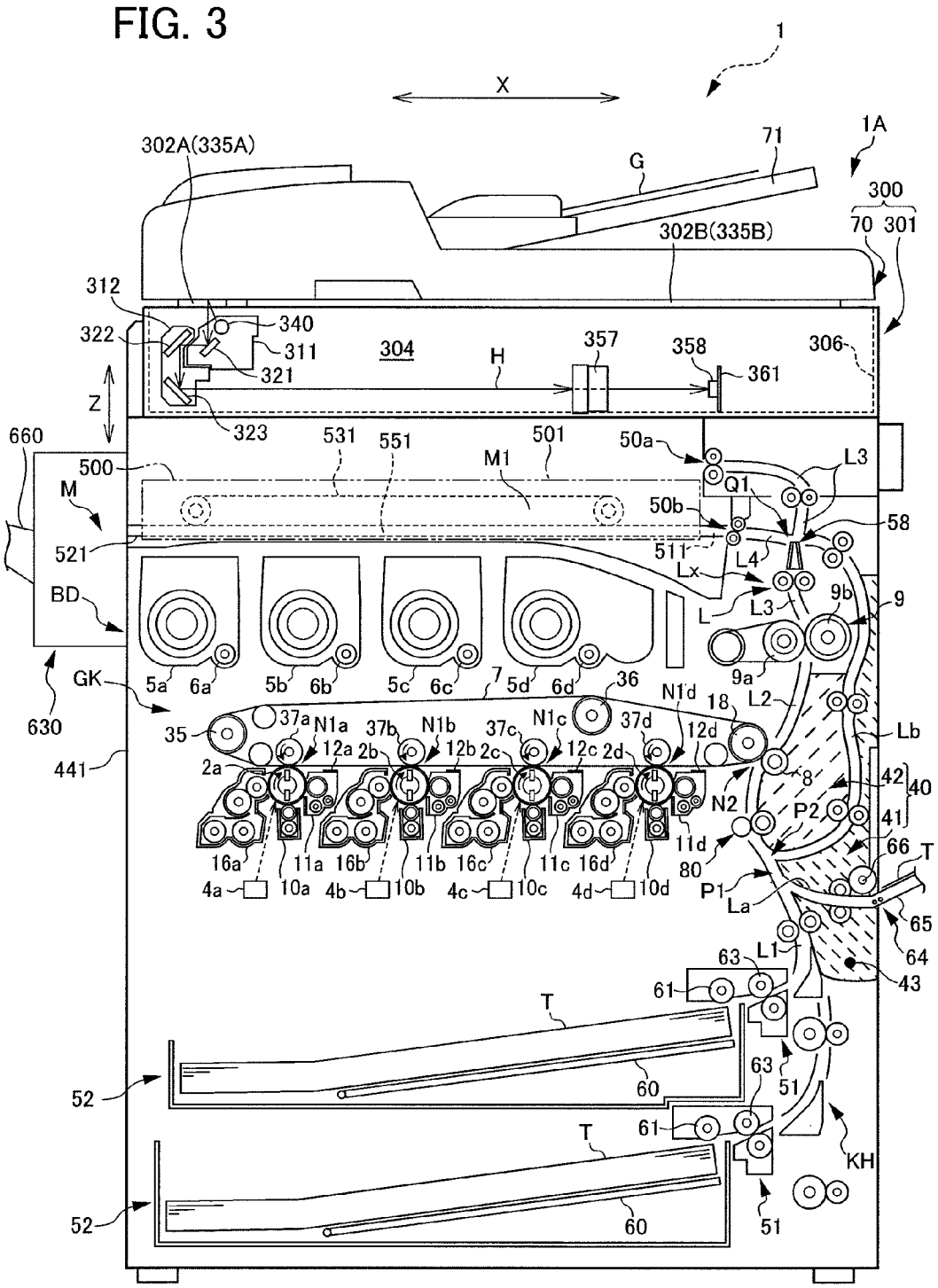
FIG. 3 is a diagram illustrating arrangement of components of the copy machine 1 shown in FIG. 1.

FIG. 3 is a diagram illustrating arrangement of components of the copy machine 1 shown in FIG. 1.

As illustrated in FIG. 3, the image reading apparatus 300 includes a reader unit 301 for reading of the image of an original G, and an original feed unit 70 disposed on an upper side of the reader unit 301 for feeding the original G to the reader unit 301.

The reader unit 301 includes a housing 306 and a first reader surface 302A and a second reader surface 302B that are disposed on an upper side of the housing 306.

In addition, the reader unit 301 includes an illumination portion 340 including a light source disposed in an internal space 304 of the housing 306, a plurality of mirrors 321, 322, and 323, a first frame body 311 and a second frame body 312 that move in the sub-scanning direction X, an imaging lens 357, a CCD 358 as a reading means, and a CCD substrate 361 that performs a predetermined process on image information read by the CCD 358 and outputs the image information to the main body device M.

The illumination portion 340 and the mirror 321 are housed in the first frame body 311.

The second mirror 322 and the third mirror 323 are housed in the second frame body 312.

The original feed unit 70 is connected with the reader unit 301 by a connecting part (not illustrated) so as to be openable and closable.

The original feed unit 70 includes an original mounting part 71 on an upper side, and a feed roller (not illustrated) in the inside thereof.

The original feed unit 70 includes the function of protecting the first reader surface 302A and the second reader surface 302B of the reader unit 301.

The first reader surface 302A is a reader surface used when reading an original G fed by the original feed unit 70.

The first reader surface 302A is formed along an upper surface of a first contact glass 335A on which the original G is fed.

The first reader surface 302A is positioned in the vicinity of a left lateral face of the housing 306.

This position shown in FIG. 1 is also referred to as a "first reading position".

The second reader surface 302B is a reader surface used when reading an original G without use of the original feed unit 70.

The second reader surface 302B is formed along an upper surface of a second contact glass 335B on which the original G is placed.

The second reader surface 302B is disposed more to the right than the first reader surface 302B, and spans the majority of the sub-scanning direction X in the reader unit 301.

The first reader surface 302A and the second reader surface 302B extend in a direction orthogonal to the sub-scanning direction X and the main scanning direction Y.

The original G fed by the original feed unit 70 is mounted on the original mounting part 71 for reading.

The original G mounted on the original mounting part 71 is fed to the first reader surface 302A of the reader unit 301 by the feeding roller provided in an inner part of the original feed unit 70.

In this case, the first frame body 311 and the second frame body 312 are located in the first reading position and not moved.

The image formed on the front surface of the original G is read by the CCD 358 by slidingly feeding the original G on the first reader surface 302A by the original feed unit 70.

When the original feed unit 70 is in an opened state, the original G is mounted on the second reader surface 302B.

In this case, the first frame body 311 and the second frame body 312 move in the sub-scanning direction X while maintaining a length of a light path H (described later) constant.

As a result, an image of the original G placed on the second reader surface 302E is read.

In the internal space 304 of the housing 306, the plurality of mirrors 321, 322 and 323 forms a light path H so that light from the original G is incident upon the imaging lens 357.

In addition, since the first frame body 311 moves in a sub-scanning direction X at a predetermined speed A while the second frame body 312 moves in the sub-scanning direction X at a predetermined speed A/2, the length of the light path H is kept constant even while reading an image.

Next, components of the main body device M are described with reference to FIG. 3.

The main body device M includes: an image forming unit GK that forms a toner image on paper T as a sheet-shaped target object based on image information transmitted from the image reading device 300; and a paper feeding/ejection portion KH that feeds the paper T to the image forming unit GK and ejects the paper T on which the toner image is formed.

An external shape of the main body device M is composed of a case member BD as a housing.

As shown in FIG. 3, the image forming unit GK includes: photoreceptor drums 2*a*, 2*b*, 2*c*, and 2*d* as image supporting bodies (photoreceptors); charging portions 10*a*, 10*b*, 10*c*, and 10*d*; laser scanner units 4*a*, 4*b*, 4*c*, and 4*d* as exposure units; developing units 16*a*, 16*b*, 16*c*, and 16*d*; toner cartridges 5*a*, 5*b*, 5*c*, and 5*d*; toner feeding portions 6*a*, 6*b*, 6*c*, and 6*d*; drum cleaning portions 11*a*, 11*b*, 11*c*, and 11*d*; static eliminator 12*a*, 12*b*, 12*c*, and 12*d*; an intermediate transfer belt 7; primary transfer rollers 37*a*, 37*b*, 37*c*, and 37*d*; a secondary transfer roller 8; an opposing roller 18; and the fusing unit 9.

As shown in FIG. 3, the paper feeding/ejection portion KH includes a paper feeding cassette 52, a manual feeding portion 64, a paper path L for the paper T, a resist roller pair 80, a first ejection portion 50*a*, and a second ejection portion 50*b*.

It should be noted that, the paper path L is an assembly of a first paper path L1, a second paper path L2, a third paper path L3, a manual paper path La, a reverse paper path Lb, and a fourth paper path L4.

Components of the image forming unit GK and the paper feeding/ejection portion KH are described in detail hereinafter with reference to FIG. 3.

First, a description is provided for the image forming unit GK.

In the image forming unit GK, performed on a surface of the photoreceptor drums 2*a*, 2*b*, 2*c* and 2*d* are: charging by the charging portions 10*a*, 10*b*, 10*c* and 10*d*; exposure by the laser scanner units 4*a*, 4*b*, 4*c* and 4*d*; development by the developing units 16*a*, 16*b*, 16*c* and 16*d*; primary transfer by the intermediate transfer belt 7 and the primary transfer rollers 37*a*, 37*b*, 37*c* and 37*d*; static elimination by the static eliminators 12*a*, 12*b*, 12*c* and 12*d*; and cleaning by the drum cleaning portions 11*a*, 11*b*, 11*c* and 11*d*, from an upstream side to a downstream side.

In addition, secondary transfer by the intermediate transfer belt 7, the secondary transfer roller 8 and the opposing roller 18, and fixation by the fusing unit 9 are performed in the image forming unit GK.

Each of the photoreceptor drums 2*a*, 2*b*, 2*c*, and 2*d* is composed of a cylindrically shaped member and function as a photoreceptor and an image supporting body.

Each of the photoreceptor drums 2*a*, 2*b*, 2*c*, and 2*d* is disposed so as to be rotatable in a direction of an arrow, about a rotational axis that extends in a direction orthogonal to a direction of movement of the intermediate transfer belt 7.

An electrostatic latent image can be formed on a surface of each of the photoreceptor drums 2*a*, 2*b*, 2*c*, and 2*d*.

The charging portions 10*a*, 10*b*, 10*c*, and 10*d* are disposed so as to face a surface of the photoreceptor drums 2*a*, 2*b*, 2*c*, and 2*d*, respectively.

The charging portions 10*a*, 10*b*, 10*c*, and 10*d* uniformly negatively charge (negative polarity) or positively charge (positive polarity) the surface of the photoreceptor drums 2*a*, 2*b*, 2*c*, and 2*d*, respectively.

Each of the laser scanner units 4*a*, 4*b*, 4*c*, and 4*d*, which functions as an exposure unit, is disposed to be spaced apart from a surface of each of the photoreceptor drums 2*a*, 2*b*, 2*c*, and 2*d*.

Each of the laser scanner units 4*a*, 4*b*, 4*c*, and 4*d* is configured to include a laser light source, a polygonal mirror, a polygonal mirror driving motor and the like, which are not illustrated.

Each of laser scanner units 4*a*, 4*b*, 4*c*, 4*d* scan and expose the front surface respectively of the photoreceptor drums 2*a*, 2*b*, 2*c*, 2*d* based on the image information related to the image read by the reader unit 301.

An electric charge of an exposed part of the surface of each of the photoreceptor drums 2*a*, 2*b*, 2*c*, and 2*d* is removed, which are scanned and exposed by the laser scanner units 4*a*, 4*b*, 4*c*, and 4*d*, respectively.

In this way, an electrostatic latent image is formed on the surface of each of the photoreceptor drums 2*a*, 2*b*, 2*c*, and 2*d*.

The developing units 16*a*, 16*b*, 16*c*, and 16*d* are disposed to correspond to the photoreceptor drums 2*a*, 2*b*, 2*c*, and 2*d*, respectively, facing corresponding surfaces of the photoreceptor drums 2*a*, 2*b*, 2*c*, and 2*d*.

The developing units 16*a*, 16*b*, 16*c*, and 16*d* each form a toner image of each color on the surface of the photoreceptor drums 2*a*, 2*b*, 2*c*, and 2*d* by depositing toner of each color on the electrostatic latent image formed on the surface of each of the photoreceptor drums 2*a*, 2*b*, 2*c*, and 2*d*.

The developing units 16*a*, 16*b*, 16*c*, and 16*d* correspond to four colors of yellow, cyan, magenta, and black, respectively.

Each of the developing units 16*a*, 16*b*, 16*c*, and 16*d* is configured to include a developing roller disposed to face a surface of each of the photoreceptor drums 2*a*, 2*b*, 2*c*, and 2*d* and a stirring roller for stirring toner.

The toner cartridges 5*a*, 5*b*, 5*c*, and 5*d* are provided corresponding to the developing units 16*a*, 16*b*, 16*c*, and 16*d*, respectively, and store the toners of different colors that are supplied to the developing units 16*a*, 16*b*, 16*c*, and 16*d*, respectively.

The toner cartridges 5*a*, 5*b*, 5*c*, and 5*d* store toners of yellow, cyan, magenta, and black respectively.

The toner feeding parts 6*a*, 6*b*, 6*c*, and 6*d* are provided to correspond to the toner cartridges 5*a*, 5*b*, 5*c*, and 5*d* and the developing units 16*a*, 16*b*, 16*c*, and 16*d*, respectively; and the toner feeding parts 6*a*, 6*b*, 6*c*, and 6*d* supply the toners of the respective colors stored in the toner cartridges 5*a*, 5*b*, 5*c*, and 5*d* to the developing units 16*a*, 16*b*, 16*c*, and 16*d*, respectively.

The toner feeding devices 6*a*, 6*b*, 6*c*, and 6*d* are connected with the developing units 16*a*, 16*b*, 16*c*, and 16*d*, respectively, via toner feeding paths (not illustrated).

Toner images of respective colors formed on the photoreceptor drums 2*a*, 2*b*, 2*c*, and 2*d* undergo primary transfer in sequence onto the intermediate image transfer belt 7.

The intermediate transfer belt 7 is stretched around the opposing roller 18 consisting of a driven roller 35 and a driving roller, a tension roller 36 and the like.

Since the tension roller 36 biases the intermediate image transfer belt 7 from inside to outside, a predetermined tension is applied to the intermediate image transfer belt 7.

Each of primary transfer rollers 37*a*, 37*b*, 37*c*, and 37*d* is opposed on the opposite side to the photoreceptor drums 2*a*, 2*b*, 2*c*, and 2*d* to thereby sandwich the intermediate image transfer belt 7.

Parts of the intermediate image transfer belt 7 are nipped between the primary image transfer rollers 37*a*, 37*b*, 37*c*, and 37*d* and the photoreceptor drums 2*a*, 2*b*, 2*c*, and 2*d*.

The nipped parts are pressed against surfaces of the photoreceptor drums 2*a*, 2*b*, 2*c*, and 2*d*.

Primary image transfer nips N1*a*, N1*b*, N1*c*, and N1*d* are formed between the photoreceptor drums 2*a*, 2*b*, 2*c*, and 2*d* and the primary image transfer rollers 37*a*, 37*b*, 37*c*, and 37*d*, respectively.

At the primary image transfer nips N1*a*, N1*b*, N1*c*, and N1*d*, toner images of the respective colors developed on the photoreceptor drums 2*a*, 2*b*, 2*c*, and 2*d* undergo primary transfer in sequence onto the intermediate image transfer belt 7.

In this manner, a full-color toner image is formed on the intermediate image transfer belt 7.

A primary transfer bias, for transferring the toner images of the colors formed on the photoreceptor drums 2*a*, 2*b*, 2*c*, and 2*d* to the intermediate transfer belt 7, respectively, is applied to each of the primary transfer rollers 37*a*, 37*b*, 37*c*, and 37*d* by primary transfer bias application portions (not illustrated).

The static eliminators 12*a*, 12*b*, 12*c*, and 12*d* are disposed so as to face a surface of the photoreceptor drums 2*a*, 2*b*, 2*c*, and 2*d*, respectively.

The static eliminators 12*a*, 12*b*, 12*c*, and 12*d* each remove electricity (eliminate an electrical charge) from a surface of each of the photoreceptor drums 2*a*, 2*b*, 2*c*, and 2*d* after the primary image transfer, by casting light on the surface of each of the photoreceptor drums 2*a*, 2*b*, 2*c*, and 2*d*.

The drum cleaning portions 11*a*, 11*b*, 11*c*, and 11*d* are disposed so as to face a surface of the photoreceptor drums 2*a*, 2*b*, 2*c*, and 2*d*, respectively.

The drum cleaning portions 11*a*, 11*b*, 11*c*, and 11*d*, remove toner and attached matter remaining on the surface of the photoreceptor drums 2*a*, 2*b*, 2*c*, and 2*d*, respectively, and make the removed toner fed to a predetermined collection mechanism for collection.

The secondary transfer roller 8 secondarily transfers the full-color toner image, which was primarily transferred to the intermediate transfer belt 7, to the paper T.

A secondary bias is applied to the secondary image transfer roller 8 to transfer the full-color toner image formed on the intermediate image transfer belt 7 to the sheet of paper T by the primary transfer bias application part (not illustrated).

The secondary image transfer roller 8 comes into contact with and departs away from the intermediate image transfer belt 7 selectively.

More specifically, the secondary image transfer roller 8 is configured to be movable between a contact position at which it is in contact with the intermediate image transfer belt 7 and a spaced position at which it is spaced apart from the intermediate image transfer belt 7.

In particular, the secondary transfer roller 8 is disposed at the contact position for transferring the toner image primarily transferred to a surface of the intermediate transfer belt 7 to the paper T, and at the spaced position in all other circumstances.

The opposing roller 18 is disposed opposite to the secondary image transfer roller 8 across the intermediate image transfer belt 7.

A part of the intermediate transfer belt 7 is sandwiched between the secondary transfer roller 8 and the opposing roller 18.

The paper T is pressed against an outer surface (a side to which the toner image is primarily transferred) of the intermediate transfer belt 7.

A secondary image transfer nip N2 is formed between the intermediate image transfer belt 7 and the secondary image transfer roller 8.

At the secondary image transfer nip N2, the full-color toner image primarily transferred to the intermediate image transfer belt 7 is secondarily transferred to the sheet of paper T.

The fusing unit 9 fuses and pressurizes color toners composing the toner image secondarily transferred to the paper T, in order to fix the color toners on the paper T.

The fusing unit 9 includes a heating rotator 9*a* that is heated by a heater, and a pressurizing rotator 9*b* that is brought into pressure-contact with the heat rotator 9*a*.

The heating rotator 9*a* and the pressurizing rotator 9*b* nip and compress, and convey the paper T to which the toner image is secondarily transferred.

The sheet of paper T is fed while nipped between the heating rotator 9*a* and the pressurizing rotator 9*b*, so that the toner transferred to the sheet of paper is fused and pressurized to be fixed to the sheet of paper T.

Next, the paper feeding/ejection portion KH is described with reference to FIG. 3.

As shown in FIG. 3, two paper feeding cassettes 52 as housing units for housing the paper T, which is the target material, are disposed one above the other on a lower side of the main body device M.

The paper feeding cassettes 52 are attached to the case member BD, which is a housing of the main body device M, so as to be insertable and removable.

In other words, the paper feeding cassettes 52 are housing units that house the paper T and are attached to the case member BD so as to be insertable and removable.

The paper feeding cassette 52 includes a paper tray 60 on which the sheets of paper T are placed.

The paper feeding cassette 52 stores the sheets of paper T stacked on the sheet of paper Tray 60.

The paper T placed on the paper tray 60 is fed to the paper path L by a cassette feeding portion 51 disposed in an end portion of the paper feeding cassettes 52 on a side of feeding the paper (in a right end portion of FIG. 3).

The cassette feeding portion 51 includes a double feed preventing mechanism consisting of: a forward feed roller 61 for picking up the paper T on the paper tray 60; and a paper feeding roller pair 63 for feeding the paper T one sheet at a time to the paper path L.

The manual feeding portion 64 is provided on a right lateral face (the right side in FIG. 3) of the main body device M.

The manual feeding portion 64 is provided primarily for the purpose of feeding paper T that is different in size and type from the paper T stored in the paper feeding cassette 52 to the main body device M.

The manual feeding part 64 includes the manual feeding tray 65, which composes a portion of a right lateral face of the main body device M in a closed state, and a paper feeding roller 66.

A lower end of the manual feeding tray 65 is pivotally connected to the main body device M in the vicinity of the paper feeding roller 66 (openable and closable).

A sheet or sheets of paper T are placed on the manual feeding tray 65 while it is open.

The paper feeding roller 66 feeds the paper T placed on the manual feeding tray 65 in an opened state to a manual feeding path La.

The first ejection portion 50*a* and the second ejection portion 50*b* are provided at a position on an upper side in the main body device M and below the reader unit 301.

The first ejection portion 50*a* and the second ejection portion 50*b* eject the paper T to the outside of the main body device M.

The first ejection portion 50*a* and the second ejection portion 50*b* are described later in detail.

The paper feed path L includes: a first paper feed path L1 from the cassette feeding part 51 to the secondary image transfer nip N2; a second paper feed path L2 from the secondary image transfer nip N2 to the fusing unit 9; a third paper feed path L3 from the fusing unit 9 to the ejection portion 50; the manual paper feed path La that guides paper fed from the manual feeding part 64 to the first paper feed path L1; a reverse paper feed path Lb that reverses and returns the paper that is fed from an upstream side to a downstream side in the third paper feed path L3 to the first paper feed path L1; and a fourth paper path L4.

The fourth paper path L4 is a paper path for feeding the paper T, which is being fed in the third paper path L3, to the second ejection portion 50*b*.

In addition, a first junction P1 and a second junction P2 are provided in the middle of the first paper path L1.

A first branch portion Q1 is provided in the middle of the third paper path L3.

The first junction P1 merges the manual paper feed path La into the first paper feed path L1.

The second junction P2 is a junction where the reverse paper path Lb joins the first paper path L1.

The first branch portion Q1 is a branch portion where the fourth paper path L4 branches off from the third paper path L3.

A switching member 58 is provided in the first branch portion Q1.

The switching member 58 shifts (switches) a feeding direction of the paper T discharged from the fusing unit 9 to the third paper path L3 leading to the first ejection portion 50*a* or to the fourth paper path L4 leading to the second ejection portion 50*b*.

In addition, a sensor for detecting the paper T and a resist roller pair 80 for skew compensation of the paper T and timing adjustment between formation of the toner image in the image forming unit GK and feed of the paper T, are disposed in the middle of the first paper path L1 (more specifically, between the second junction P2 and the secondary transfer roller 8).

The sensor is disposed immediately in front of the regisit rollers 80 in the direction of feeding of the sheet of paper T (upstream side in the feeding direction).

The regisit roller pair 80 is a pair of rollers that feeds the paper T by adjusting the timing or the correction described above based on the detection signal information from the sensor.

For a case of performing duplex printing of the paper T, a reverse paper path Lb is provided for making an opposite surface (an unprinted surface), to a surface that has already been printed, face toward the intermediate transfer belt 7.

The reverse paper path Lb can reverse and return the paper T, conveyed from the first branch portion Q1 toward the ejection portion 50*b*, to the first paper path L1, in order to convey the paper T to an upstream side of the regist roller pair 80 disposed on an upstream side of the secondary transfer roller 8.

In the secondary transfer nip N2, a toner image is transferred to the unprinted surface of the paper T that is reversed by the reverse paper path Lb.

The first ejection portion 50*a* is formed in an end portion of the third paper path L3.

The first ejection portion 50*a* ejects the paper T, which does not require a post-process, to the outside of the main body device M.

As shown in FIG. 3, the first ejection portion 50*a* is disposed at a position on an upper side in the main body device M and below the reader unit 301.

In addition, the first ejection portion 50*a* has an opening toward a left lateral face of the main body device M (left side in FIG. 3) and is disposed at a position on a right lateral face side of the main body device M.

As shown in FIG. 2, an ejected paper accumulating portion M1 is formed on a side to the opening of the first ejection portion 50*a*.

The ejected paper accumulating portion M1 is formed below the reader unit 301 in the main body device M.

The ejected paper accumulating portion M1 is a space having an opening on a front face of the main body device M.

The paper T, to which a predetermined toner image is formed, ejected from the first ejection portion 50*a* is stacked and accumulated in the ejected paper accumulating portion M1.

The paper T accumulated in the ejected paper accumulating portion M1 can be taken out from a front opening of the main body device M.

In addition, in the present embodiment, as shown in FIG. 2, a space below the space of the ejected paper accumulating portion M1 also functions as a unit attachment space 420 that houses the relay unit 500 so as to be insertable and removable.

As shown in FIG. 3, the second ejection portion 50*b* is formed in an end portion (on a downstream side in the feeding direction) of the fourth paper path L4.

The second ejection portion 50*b* is formed below the first ejection portion 50*a*, to have an opening directed to the ejected paper accumulating portion M1.

The second ejection portion 50*b* is an ejection portion for post-processing (or an ejection portion for the relay unit) that feeds the paper T being conveyed on the fourth paper path L4 to the post-processing unit 630 via the relay unit 500 (described later).

The relay unit 500 is disposed sequentially with respect to the opening side of the second ejection portion 50*b* (connected to the main body device M).

The post-processing unit 630 is disposed sequentially with respect the relay unit 500 (connected to the main body device M via the supporting unit 600).

The post-processing unit 630 executes post-processing (stapling, punching, sorting and the like) of the paper that is ejected from the second ejection portion 50*b* and fed via the relay unit 500.

It should be noted that a sensor for detecting a sheet of paper is disposed at a predetermined position of each paper feed path.

Next, a structure for eliminating paper jams in main paper paths L1 to L3 (the first paper path L1, the second paper path L2, and the third paper path L3 are also collectively referred to as "main paper paths" hereinafter) and in the reverse paper path Lb is briefly described.

As shown in FIG. 3, on a right lateral face side of the main body device M (right side in FIG. 3), the main paper paths L1 to L3 and the reverse paper path Lb are disposed in parallel so as to extend mainly in a perpendicular direction.

On a right lateral face side of the main body device M (right side in FIG. 3), a cover body 40 is provided so as to constitute a part of the lateral face of the main body device M.

A lower end portion of the cover body 40 is connected with the main body device M via a fulcrum shaft 43.

The fulcrum shaft 43 is disposed so that an axial direction thereof is along a direction intersecting the main paper paths L1 to L3 and the reverse paper path Lb.

The cover body 40 is pivotally configured about the fulcrum shaft 43 between a closed position (shown in FIG. 3) and an opened position (not shown).

The cover body 40 is composed of a first cover portion 41 that is pivotally connected with the main body device M by the fulcrum shaft 43 and a second cover portion 42 that is pivotally connected with the main body device M by the same fulcrum shaft 43.

The first cover portion 41 is positioned more outward (to a lateral face side) in the main body device M than the second cover portion 42.

It should be noted that, in FIG. 3, the first cover portion 41 is a part hatched with falling diagonal broken lines from top right to bottom left, and the second cover portion 42 is a part hatched with falling diagonal broken lines from top left to bottom right.

In a state where the cover body 40 is in a closed position, an outer face side of the first cover portion 41 constitutes a portion of an outer face (lateral face) of the main body device M.

In addition, in a state in which the cover body 40 is in the closed position, an inner face side (a side to the main body device M) of the second cover portion 42 constitutes a portion of the main paper paths L1 to L3.

Furthermore, in a state where the cover body 40 is in the closed position, an inner face side of the first cover portion 41 and an outer face side of the second cover portion 42 constitute at least a portion of the reverse paper path Lb.

In other words, the reverse paper path Lb is formed between the first cover portion 41 and the second cover portion 42.

Since the copy machine 1 according to the present embodiment is provided with the cover body 40 thus configured, in a case where a paper jam occurs in the main paper paths L1 to L3, jammed paper in the main paper paths L1 to L3 can be removed by opening the main paper paths L1 to L3 by pivoting the cover body 40 from the closed position shown in FIG. 3 to the opened position (not shown).

On the other hand, in a case in which a paper jam occurs in the reverse paper path Lb, jammed paper in the reverse paper path Lb can be removed by opening the reverse paper path Lb by pivoting the cover body 40 to the opened position and then pivoting the second cover portion 42 about the fulcrum shaft 43 toward the main body device M (right side in FIG. 3).

In the copy machine 1 described above, the relay unit 500 and the post-processing unit 630 that are optional units are attached to the main body device M (copy machine main body 1A) that forms an image on the paper T as the target material.

In addition, the main body device M includes, as described above: the case member BD that constitute the external shape; the paper feeding cassettes 52; the main power supply unit 400; the image forming unit GK; the second ejection portion 50*b* (main body ejection portion); and paper paths Lx (L3, L4) for post-processing.

The paper feeding cassettes 52 house the paper T and are attached to the case member BD, which is a housing of the main body device M, so as to be insertable and removable.

The main power supply unit 400 is connected to an external power source, is supplied with power of a first voltage, performs a transformation process, and feeds power required to operate driving units, to a driving unit of the image reading device 300 and various driving units that are provided by standard in the main body device M (copy machine main body 1A).

In addition, as shown in FIG. 2, the main power supply unit 400 includes the first voltage output connector 410 that can directly supply power of the first voltage from the external power source to the power unit 620, without transformation.

In other words, the main power supply unit 400 is configured to output power to driving units and the like constituting the image reading device 300 included in the main body device M (copy machine main body 1A), and to supply power of the first voltage from the external power source to the power unit 620 via the first voltage output connector 410.

The image forming unit GK is driven by the power supplied from the main power supply unit 400 and forms an image on the paper T.

The second ejection portion 50*b* is the main body ejection portion that ejects the paper T on which the image is formed by the image forming unit GK to the outside of the main body device M (case member BD) in order to feed the paper T to the post-processing unit 630.

The paper path Lx for post-processing feeds the paper T stored in the paper feeding cassettes 52 and feeds the paper T on which an image is formed by the image forming unit GK to the second ejection portion 50*b*.

The paper path Lx for post-processing is a paper path illustrated in FIG. 3, that extends from the paper feeding cassettes 52 and runs through the first paper path L1, the second paper path L2, the third paper path L3 (partially), and the fourth paper path L4, reaching the second ejection portion 50*b*.

Next, with reference to FIGS. 2 to 6, configurations of the relay unit 500, the supporting unit 600, the power unit 620 and the post-processing unit 630 are described in detail.

Figure 4:
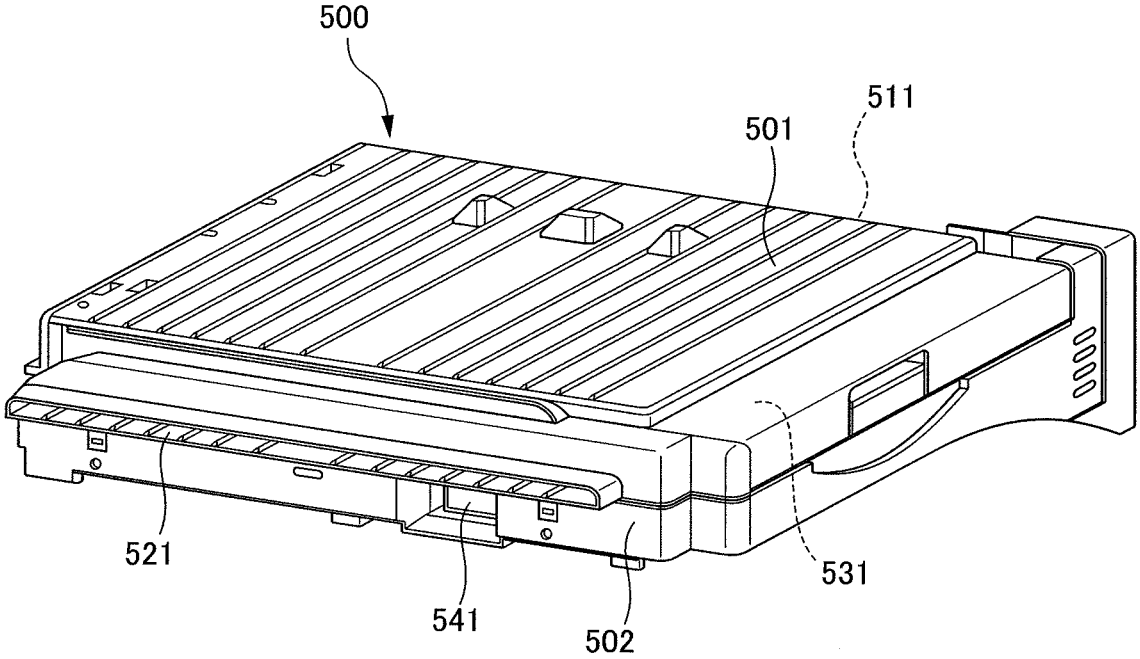
FIG. 4 is a perspective view seen from an upper side of a left lateral face of a relay unit 500 that is attached to the main body device M so as to be insertable and removable.

FIG. 4 is a perspective view seen from an upper side of a left lateral face of a relay unit 500 that is attached to the main body device M so as to be insertable and removable.

Figure 5:
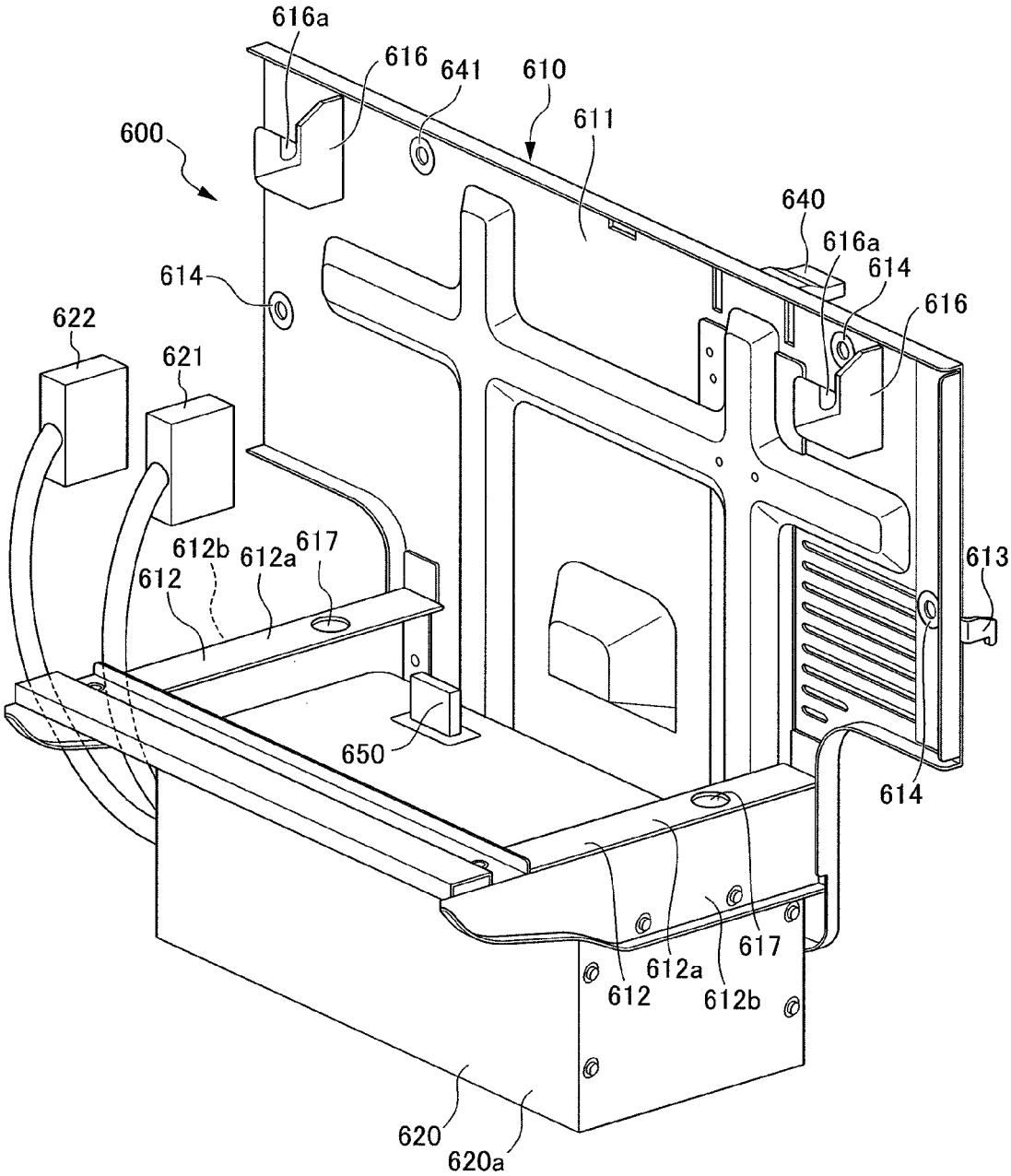
FIG. 5 is a perspective of a frame body 610 constituting a supporting unit 600 attached to the main body device M and a power unit 620 that is fixed to the frame body 610.

FIG. 5 is a perspective of a frame body 610 constituting a supporting unit 600 attached to the main body device M and a power unit 620 that is fixed to the frame body 610.

Figure 6:
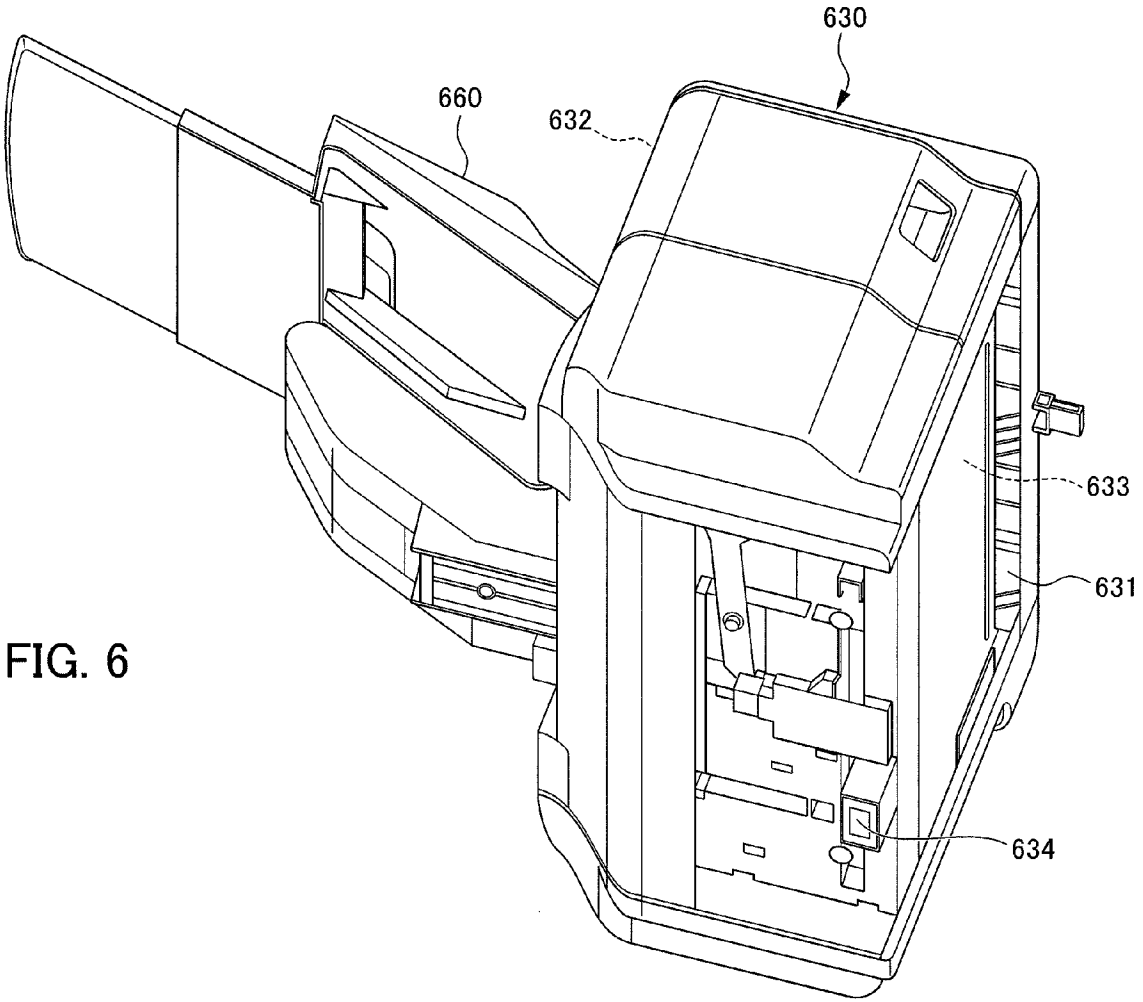
FIG. 6 is a perspective view seen from a lower side of a right lateral face of a post-processing unit 630 that is attached to the supporting unit 600.

FIG. 6 is a perspective view seen from a lower side of a right lateral face of a post-processing unit 630 that is attached to the supporting unit 600.

The relay unit 500 has a thin box shape, which is small in height.

The relay unit 500 can be inserted into and removed from the unit attachment space 420, from the front face side of the main body device M (see FIG. 2).

Here, an arrow Y1 shown in FIG. 2 represents an insertion and removal direction of the relay unit 500 with respect to the unit attachment space 420.

The relay unit 500 is attached to the unit attachment space 420 in such a way that the right lateral face thereof is directed to the second ejection portion 50*b* and the left lateral face thereof is disposed on a side to the opening 430 on the left lateral face of the main body device M (see FIG. 2).

In addition, in a state in which the relay unit 500 is installed in the unit attachment space 420, the upper end face 501 of the relay unit 500 functions as a paper accumulating surface for accumulating the paper T ejected from the first ejection portion 50*a* of the main body device M.

As shown in FIGS. 2 and 4, the relay unit 500 is provided with a relay unit inlet 511, a relay unit outlet 521, a relay unit feeder 531, and a relay unit connector 541.

As shown in FIGS. 2 and 3, the relay unit inlet 511 is disposed on the right lateral face of the relay unit 500 so as to face the second ejection portion 50*b*.

The relay unit inlet 511 is a portion through which the paper T ejected from the second ejection portion 50*b* of the main body device M is accepted (fed in).

As shown in FIG. 4, the relay unit outlet 521 is disposed on the left lateral face 502 of the relay unit 500.

The relay unit outlet 521 is a portion through which the paper T, which is fed into the relay unit 500 through the relay unit inlet 511, is fed to the outside of the relay unit 500.

Here, the relay unit outlet 521 is disposed to face the post-processing unit inlet 631 (described later).

Inside the relay unit 500 is formed an internal paper path 551 (see FIG. 3) that guides the paper T, fed in through the relay unit inlet 511, to the relay unit outlet 521.

The relay unit feeder 531 is a paper feeding means provided inside the relay unit 500 (see FIG. 3).

The relay unit feeder 531 feeds the paper T, fed in through the relay unit inlet 511, to the relay unit outlet 521 along the internal paper path 551.

In addition, the relay unit feeder 531 is driven by power of a second voltage, different from the first voltage output from the main power supply unit 400 of the main body device M, and supplied by the power unit 620.

As shown in FIG. 4, the relay unit connector 541 is formed on the left lateral face 502 of the relay unit 500.

The relay unit connector 541 is formed in the vicinity of the relay unit outlet 521 so as to extend in a horizontal direction.

A connecting part of the relay unit connector 541 is disposed to be directed to the horizontal direction.

In the present embodiment, the relay unit connector 541 is disposed at a position perpendicularly below the relay unit outlet 521.

The relay unit connector 541 is a connector to which the power of the second voltage that is required for driving the relay unit feeder 531 is supplied.

The supporting unit 600 is detachably attached to the left lateral face 441 of the main body device M (see FIGS. 1 and 3).

The supporting unit 600 is provided with the frame body 610 and a first connector 640 (see FIGS. 1 and 2).

The frame body 610 is connected to the left lateral face 441 of the main body device M (see FIGS. 1 and 2).

The frame body 610 is a member for fixing the post-processing unit 630 to the main body device M.

As shown in FIG. 5, the frame body 610 is provided with a perpendicular wall portion 611 that extends along the left lateral face 441 of the main body device M (see FIG. 2) and horizontal supporting mounts 612, 612 that extends in a horizontal direction from a central part of the perpendicular wall portion 611.

As shown in FIG. 5, the perpendicular wall portion 611 is provided with engagement hooks 613 and through holes 614 (4 in the present embodiment) for screw-fixing as a connecting means for the main body device M with respect to the left lateral face 441.

The engagement hooks 613 are moved horizontally toward the main body device M and inserted into engagement holes (not illustrated) formed on the left lateral face 441 of the main body device M.

As a result, the frame body 610 is engaged (temporarily fixed) with the main body device M in a state in which the perpendicular wall portion 611 faces (is in total contact with) the left lateral face 441.

By inserting and rotating predetermined screws into the through holes 614 in this engaged (temporary fixed) state, the perpendicular wall portion 611 (the frame body 610) is connected and fixed to the left lateral face 441 (the main body device M).

Here, the frame body 610 according to the present embodiment can be attached to the main body device M by moving the frame body 610 in the horizontal direction.

As a result, the present embodiment is configured such that an electrical connection operation between the relay unit 500 and the transformation unit 620 on the frame body 610 can be simplified.

In addition, as shown in FIG. 5, the frame body 610 is provided with a unit engagement hook 616 and a connection hole 617 as a means for connecting the post-processing unit 630.

The unit engagement hook 616 is provided on the perpendicular wall portion 611.

The unit engagement hook 616 has an engagement groove 616*a* with an opening directed upward in the perpendicular direction.

The unit engagement hook 616 is engaged with a back face portion of the post-processing unit 630 that is placed on the connection hole 617 from above, thereby restricting horizontal movement of the post-processing unit 630.

The connection hole 617 is formed to penetrate a supporting plate portion 612*a* on a top part of the horizontal supporting mount 612 on which the post-processing unit 630 is placed.

The connection hole 617 is a hole for screw-fixing the post-processing unit 630 to the frame body 610.

Since the attachment direction of the frame body 610 with respect to the main body device M is orthogonal to the attachment direction of the post-processing unit 630 with respect to the frame body 610, a load applied upon attachment of the post-processing unit 630 does not have much influence on attachment of the frame body 610 with respect to the main body device M, thereby improving attachability of each optional unit.

As shown in FIG. 5, the first connector 640 is disposed on a face of an upper portion of the frame body 610 on a side of the main body device M, such that an engaging direction extends in the horizontal direction.

A connecting part of the first connector 640 is disposed to be directed in the horizontal direction (right side of FIG. 2).

In addition, the first connector 640 is disposed on the perpendicular wall portion 611 so as to project horizontally toward the main body device M.

When the frame body 610 is attached to the left lateral face 441 of the main body device M, the first connector 640 is engaged with (connected to) the relay unit connector 541 provided in the relay unit 500.

Here, the frame body 610 is moved in the horizontal direction to be attached to the main body device M.

In other words, by attaching the frame body 610 to the main body device M by moving the frame body 610 horizontally, the first connector 640 is engaged with (connected to) the relay unit connector 641 that is disposed to extend in the horizontal direction as the first connector 640, such that the connecting part thereof is directed to the first connector 640.

The first connector 640 is electrically connected to the power unit 620 and supplies power of the second voltage, which is transformed by the power unit 620, to the relay unit feeder 531 of the relay unit 500 via the relay unit connector 541.

As shown in FIG. 5, in the power unit 620, a transformation unit (not illustrated) and the like are stored in a box-shape housing 620*a* and the housing 620*a* is attached to a perpendicular face 612*b* that extends downwards from the supporting plate portion 612*a* on a top part of the horizontal supporting mount 612.

The power unit 620 is attached to the frame body 610 before attaching the frame body 610 to the main body device M.

In other words, the power unit 620 is attached to the frame body 610 in advance and attached to the main body device M integrally with the frame body 610.

In the power unit 620, an input connector 621, which is connected to the first voltage output connector 410 of the main power supply unit 400, is provided at a tip of a cable extending from the housing 620*a*.

The power unit 620 is supplied with power of the first voltage from the main power supply unit 400 via the first voltage output connector 410.

The power unit 620 is supplied with power of the first voltage from the main power supply unit 400, transforms the voltage thus supplied to a voltage required for driving the relay unit 500 and the post-processing unit 630 by the transformation unit, and outputs the power thus transformed (from at least one of the first connector 640 and the second connector 650 (described later)).

In addition, a signal output connector 411 that outputs a control signal is provided in the main body device M.

In the power unit 620, a signal input connector 622, which is connected to the signal output connector 411, is provided at a tip of a cable extending from the housing 620*a*.

The control signal output from the main body device M is supplied to the relay unit 500 and the post-processing unit 630 via the first connector 640 and the second connector 650.

As shown in FIG. 5, the second connector 650 is provided on an upper surface of the power unit 620 fixed to the frame body 610, so as to project perpendicularly upward.

Therefore, a connecting part of the second connector 650 is disposed to be directed in the perpendicular direction.

When the post-processing unit 630 is attached to the horizontal supporting mount 612 of the frame body 610, the second connector 650 is connected to (engaged with) the post-processing unit connector 634 that is provided on a lower surface of the post-processing unit 630.

The second connector 650 is electrically connected to the power unit 620 and supplies power of the second voltage or a third voltage different from the first voltage, which is transformed by the power unit 620, to a driving unit in the post-processing unit 630 via the post-processing unit connector 634.

The post-processing unit connector 634 provided in the post-processing unit 630 and the second connector 650 in the power unit 620, to which the post-processing unit connector 634 is engaged and connected, both have connecting parts directed in the perpendicular direction.

Therefore, the post-processing unit 630 is moved in the horizontal direction to be attached to the frame body 610.

The post-processing unit 630 is detachably attached to the frame body 610.

The post-processing unit 630 is attached to the post-processing unit 630 via the frame body 610 (see FIGS. 1 and 2).

As shown in FIGS. 2 and 6, the post-processing unit 630 is provided with a post-processing unit inlet 631, a post-processing unit outlet 632, a post-processing part 633, and the post-processing unit connector 634.

The post-processing unit inlet 631 is a part (opening) through which the paper T that is fed from the relay unit outlet 521 of the relay unit 500 is fed in.

The post-processing unit inlet 631 is disposed to face the relay unit outlet 521.

The post-processing unit inlet 631 is disposed to face the relay unit outlet 521, so as to be connected thereto.

The post-processing unit outlet 632 is a part (opening) through which the paper T that is fed into the post-processing unit 630 through the post-processing unit inlet 631 is ejected to the outside of the post-processing unit 630.

The post-processing unit outlet 632 is configured to eject paper T, which is processed in a predetermined manner by the post-processing part 633, to the outside of the post-processing unit 630.

As shown in FIGS. 2 and 6, the post-processing unit 630 is provided with an ejected paper tray 660 that is disposed continuously to the post-processing unit outlet 632.

The ejected paper tray 660 is an ejected paper tray in which the paper T, which is ejected from the post-processing unit outlet, is accumulated.

The post-processing part 633 is provided in the post-processing unit 630 and performs post-processing such as stapling, punching and the like with respect to the paper T that is fed in through the post-processing unit inlet 631.

The post-processing part 633 also has a function of feeding the paper T thus post-processed to the post-processing unit outlet 632.

In the present embodiment, the post-processing part 633 is driven by a supply of power of the second voltage or the third voltage, which is different from the first voltage.

The post-processing part 633 is driven by a supply of power of the second voltage, which is supplied to the relay unit 500, or power of the third voltage, which is different either from the first and second voltages.

Here, if the post-processing part 633 is driven by a supply of power of the second voltage, the power unit 620 requires only one transformation processing unit.

On the other hand, if the post-processing part 633 is driven by a supply of power of the third voltage, the power unit 620 requires two transformation processing units.

As shown in FIG. 6, the post-processing unit connector 634 is provided on a lower surface of the post-processing unit 630, so as to project perpendicularly downward.

A connecting part of the post-processing unit connector 634 is disposed to be directed downward in the perpendicular direction.

The post-processing unit connector 634 is a connector to which the power of the second or third voltage is supplied.

When the post-processing unit connector 634 is attached to the frame body 610, the second connector 650 provided in the transformation unit 620 is engaged with (connected to) the post-processing unit connector 634.

As a result, the post-processing unit 630 is supplied with power from the power unit 620 via the post-processing unit connector 634 connected to the second connector 650.

Next, with reference to FIGS. 7A to 7D, steps for attaching the relay unit 500, the frame body 610 and the post-processing unit 630 to the main body device M are described.

Figure 7A:
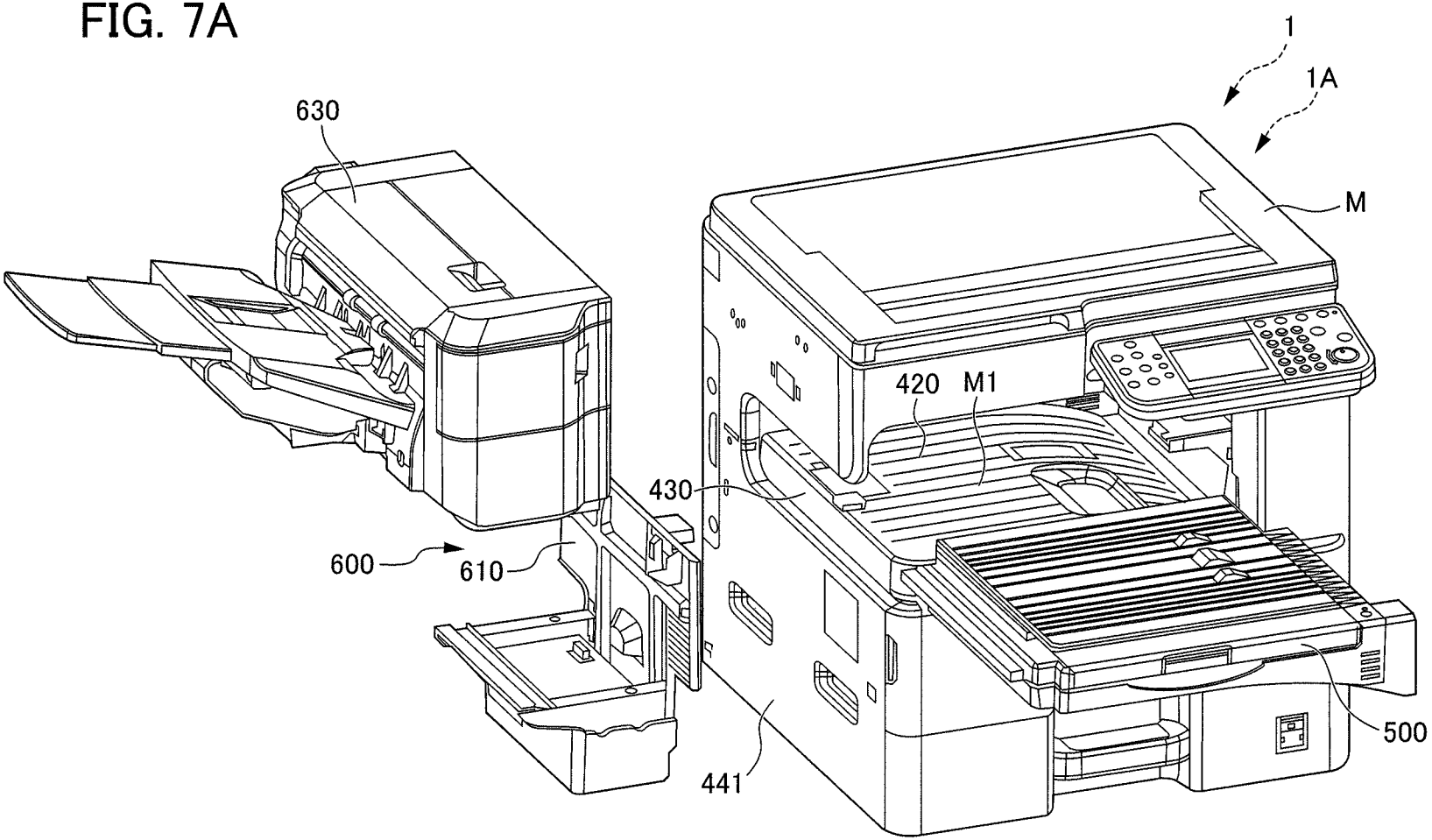
FIG. 7A is a perspective view illustrating attachment orientations, with respect to the main body device M, the relay unit 500, the supporting unit 600 and the post-processing unit 630 before being attached to the main body device M.

FIG. 7A is a perspective view illustrating attachment orientations, with respect to the main body device M, of the relay unit 500, the frame body 610 and the post-processing unit 630 before being attached to the main body device M.

Figure 7B:
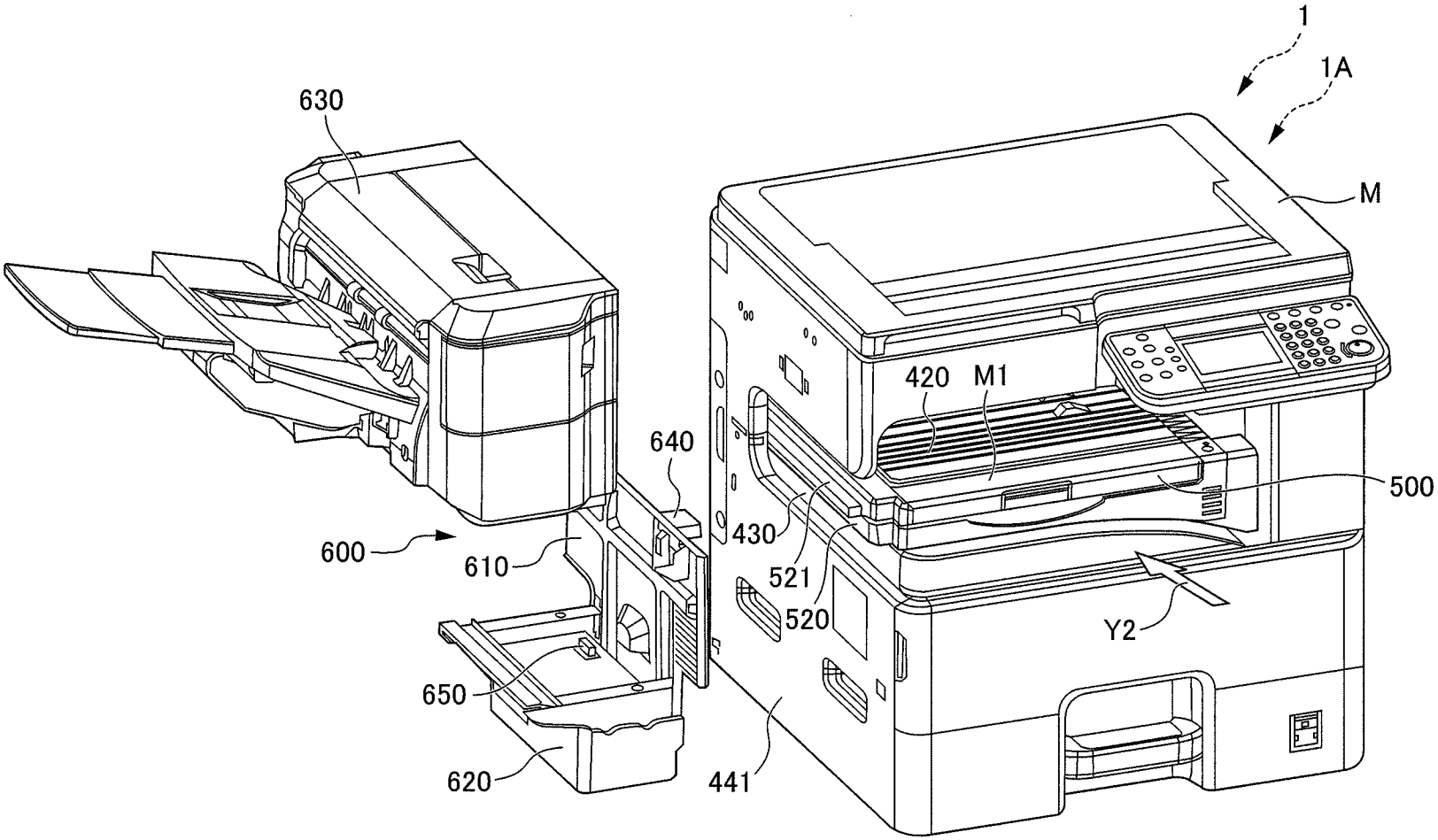
FIG. 7B is a perspective view of a state in which the relay unit 500 is attached to the main body device M.

FIG. 7B is a perspective view of a state in which the relay unit 500 is attached to the main body device M.

Figure 7C:
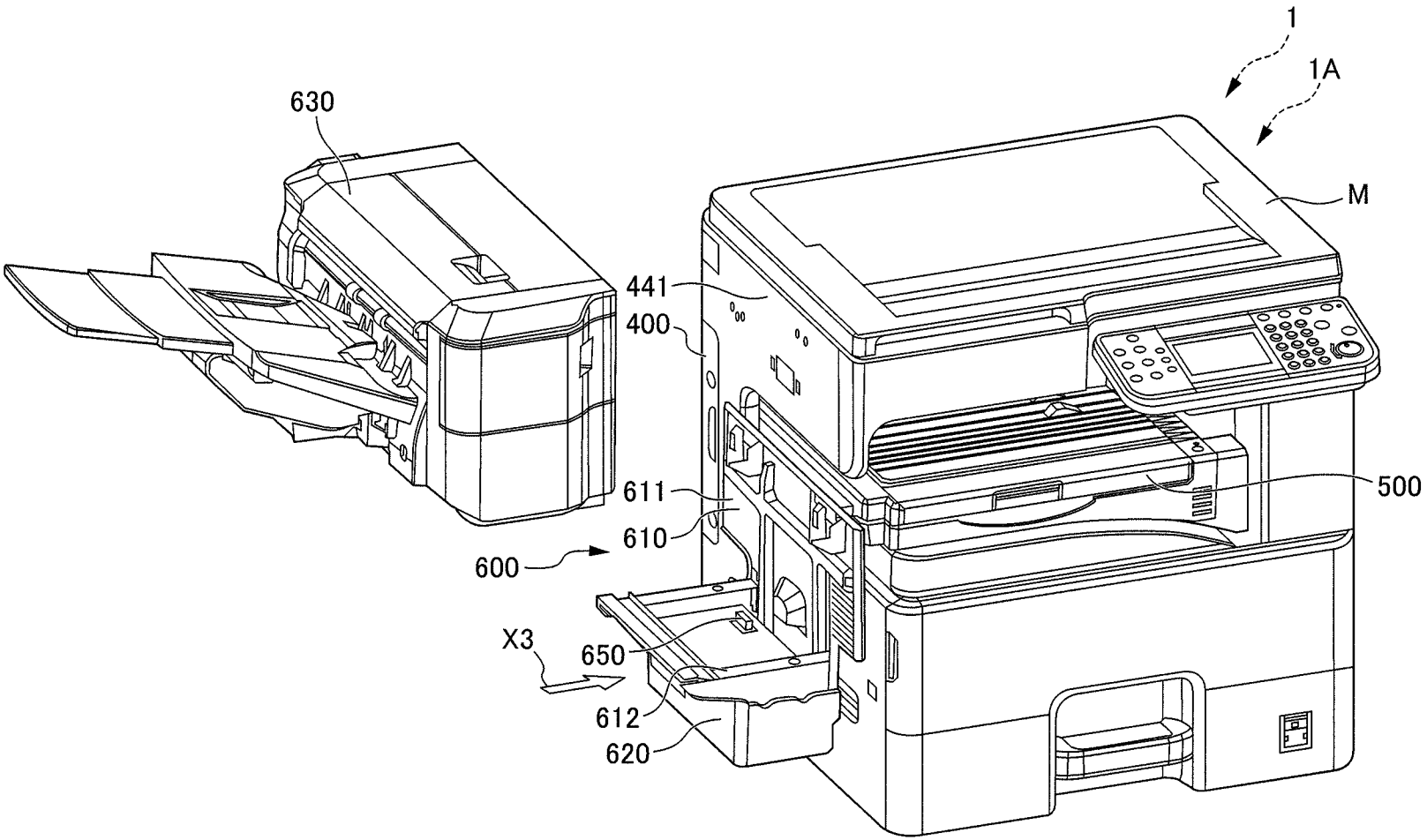
FIG. 7C is a perspective view of a state in which the frame body 610 of the supporting unit 600 is attached to the main body device M.

FIG. 7C is a perspective view of a state in which the frame body 610 of the supporting unit 600 is attached to the main body device M.

Figure 7D:
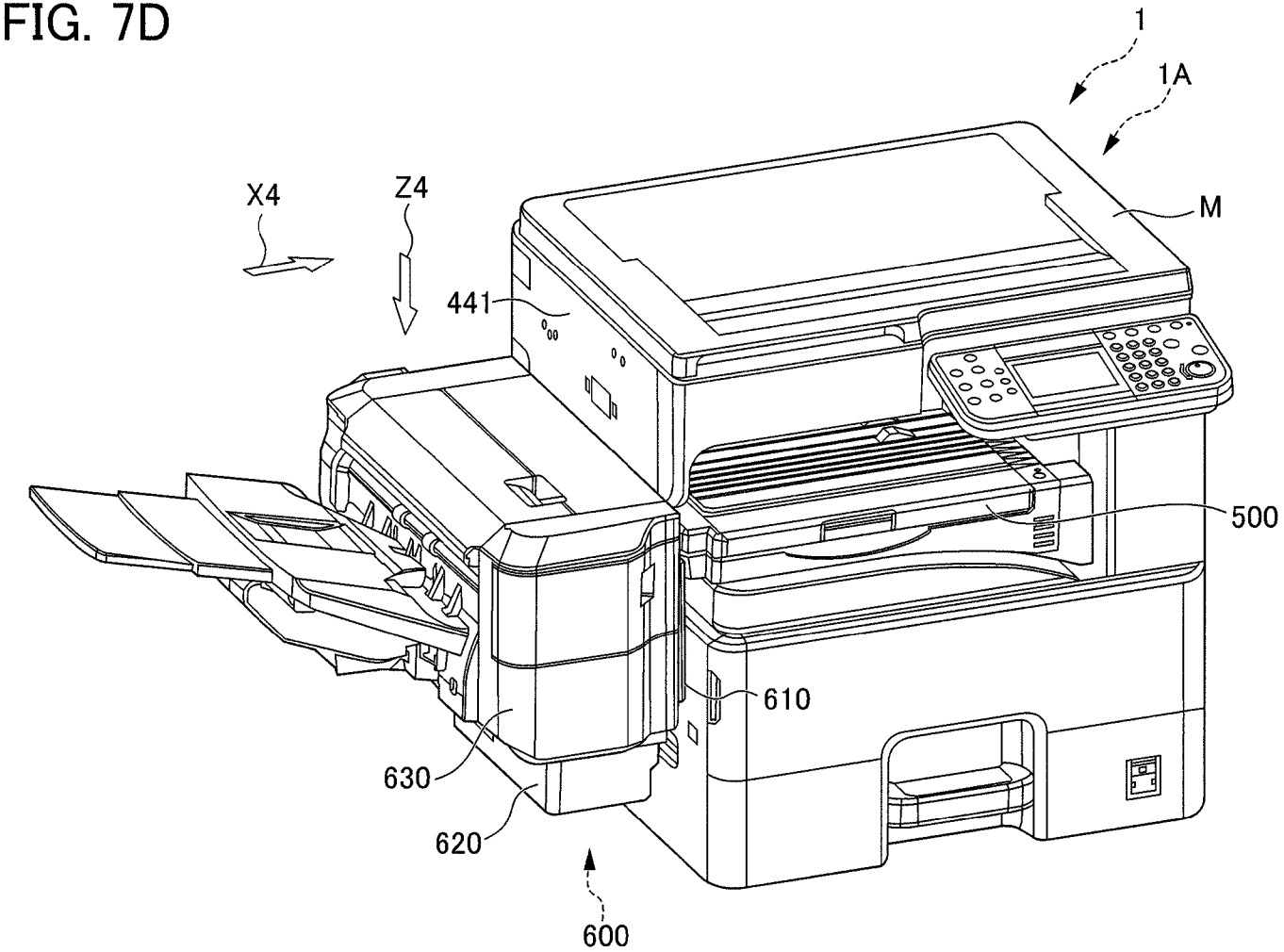
FIG. 7D is a perspective view of a state in which the post-processing unit 630 is attached to the frame body 610 fixed to the main body device M.

FIG. 7D is a perspective view of a state in which the post-processing unit 630 is attached to the frame body 610 fixed to the main body device M.

First, as shown in FIGS. 7A and 7B, a user attaches the relay unit 500 to the main body device M by moving the relay unit 500 in a direction of an arrow Y2.

In other words, the relay unit 500 is attached to the main body device M in such a way that the user inserts the relay unit 500 from a front face side of the main body device M, in a horizontal direction into the unit attachment space 420 in the ejected paper accumulating portion M1.

In a state in which the relay unit 500 is attached to the main body device M, the relay unit outlet 521 and the relay unit connector 541 that are arranged on the left lateral face 502 of the relay unit 500 (see FIG. 4) are disposed to be exposed through the opening 430 to the left lateral face 441 of the main body device M.

After attaching the relay unit 500 to the main body device M, the user attaches the frame body 610 with the power unit 620 having the second connector 650 and the first connector 640 attached thereto to the left lateral face 441 of the main body device M.

As shown in FIGS. 7B and 7C, the user places the frame body 610 such that a face of the perpendicular wall portion 611, from which the first connector 640 projects, faces the left lateral face 441 of the main body device M in parallel therewith.

Next, the user moves the frame body 610 in a direction of an arrow X3.

The user attaches the frame body 610 to the left lateral face 441 of the main body device M by further moving the frame body 610 such that a position of the connecting part of the first connector 640 corresponds to a position of the relay unit connector 541 of the relay unit 500.

By inserting the engagement hooks 613 into the engagement holes (not illustrated) formed on the left lateral face 441 of the main body device, while inserting and rotating predetermined screws into the through holes 614, the user connects and fixes the frame body 610 to the main body device M.

Here, the frame body 610 is attached to the left lateral face 441 of the main body device M by movement in the horizontal direction.

Here, both moving direction of the frame body 610 and connecting direction of the first connector 640 and the relay unit connector 541 are in a horizontal direction.

Therefore, if the user performs an attaching operation of the frame body 610, the first connector 640 and the relay unit connector 541 are engaged with and connected to each other.

After completion of attachment of the frame body 610 to the main body device M, the user attaches the post-processing unit 630 to the frame body 610.

As shown in FIGS. 7C and 7D, the user holds the post-processing unit 630 higher than the frame body 610.

The user moves the post-processing unit 630 in a direction of an arrow X4 (horizontal direction) to strike a back face of the post-processing unit 630 against the perpendicular wall portion 611, and further moves the post-processing unit 630 in a perpendicular direction shown by an arrow Z4 to place a lower face of the post-processing unit 630 on the horizontal supporting mount 612 of the frame body 610 (see FIG. 5).

Thereafter, the user fixes the post-processing unit 630 to the horizontal supporting mount 612 of the frame body 610 by means of the connection hole 617.

Attachment of the post-processing unit 630 to the frame body 610 is thus completed.

In an operation of placing the post-processing unit 630 on the horizontal supporting mount 612 of the frame body 610 by perpendicular movement, both moving direction of the post-processing unit 630 and connecting direction of the second connector 650 and the post-processing unit connector 634 are the perpendicular direction, and the second connector 650 and the post-processing unit connector 634 can be engaged with and connected to each other by an attaching operation of the post-processing unit 630.

As shown in FIG. 7D, after properly attaching the relay unit 500, the frame body 610 and the post-processing unit 630 to the main body device M, the power unit 620 attached to the frame body 610 can operate.

The power unit 620 can thus transform power of the first voltage supplied from the main power supply unit 400 of the main body device M to power of the second voltage, and then supply the power to the relay unit 500.

In addition, the power unit 620 can transform power of the first voltage supplied from the main power supply unit 400 of the main body device M to power of the third voltage that is different from the first voltage, and then supply the power to the post-processing unit 630.

Therefore, it is not necessary to provide a transformation unit for optional devices in the main body device M, thereby reducing cost for the main body device M.

As shown in FIG. 1, the copy machine 1 in which the relay unit 500 and the post-processing unit 630 are properly attached, and the paper T requiring post-processing, on which an image is formed in the image forming unit GK, passes through the fusing unit 9 (illustrated in FIG. 3) and is fed to the third paper path L3, and then fed from the first branch portion Q1 to the fourth paper path L4.

The paper T fed to the fourth paper path L4 illustrated in FIG. 3 is further fed from the second ejection portion 50*b* to the post-processing unit 630 via the relay unit 500.

The paper T fed to the post-processing unit 630 is subjected to predetermined post-processing in the post-processing unit 630 and then ejected to the ejected paper tray 660.

Here, in the copy machine 1 according to the present embodiment, an ejection route for the paper T after image formation in the image forming unit GK can be set in any of the following two ways, if no post-processing is required.

Although the copy machine 1 feeds the paper T to the post-processing unit 630 via the fourth paper path L4 and the relay unit 500, the post-processing unit 630 can be set to eject the paper T to the ejected paper tray 660 without performing the post-processing.

In addition, the copy machine 1 can be set to eject the paper T to the ejected paper accumulating portion M1 from the first ejection portion 50*a* of the third paper path L3, without feeding to the fourth paper path L4.

The paper T ejected from the first ejection portion 50*a* to the ejected paper accumulating portion M1 is accumulated on the upper end face 501 of the relay unit 500 and removed from a front face side of the main body device M.

The image forming apparatus of the present invention is not particularly limited, and can be a copy machine, a printer, a facsimile machine, or a multi-functional printer having functions thereof.

In addition, the sheet-shaped target material is not limited to paper, and can be a film sheet, for example.

In the above embodiment, a case in which the driving voltage of the post-processing unit 630 (the third voltage) is different from the driving voltage of the relay unit 500 (the second voltage) has been described.

However, both the post-processing unit 630 and the relay unit 500 can obviously be driven with the second voltage.

What is claimed is:

1. An image forming apparatus comprising:

a main body device, on which an image reading device to read an image of a document is provided, configured to form the image on a target material, the main body device including, a case member that constitutes an outer shape thereof, a storage unit that stores the target material and is insertable to and removable from the case member, a main power supply unit to which power at a first voltage supplied from an external power source is input and which can output power at the first voltage, an image forming unit that is driven by a first portion of the power at the first voltage supplied from the main power supply unit and that forms an image on the target material, a main body ejection portion that ejects the target material on which the image is formed by the image forming unit, to an outside of the case member, an ejected paper accumulating portion which is provided below the image reading device and configured to accommodate the target material ejected from the main body ejection portion, and a main body feeder that feeds the target material stored in the storage unit to the image forming unit and feeds the target material on which the image is formed by the image forming unit to the main body ejection portion; and a post-processing device attached to the main body device, including, a supporting unit having a frame body that comprises a perpendicular wall portion extending in a vertical direction and a supporting mount projecting horizontally from the perpendicular wall portion, the supporting unit being attached externally to a side surface of the main body device, a power unit attached to the frame body under the supporting mount of the supporting unit and electrically connected to the main power supply unit to be supplied with a second portion of the power at the first voltage through the main power supply unit, the power unit configured to transform the power thus supplied to a second voltage and to output the transformed power, a relay unit configured to be attachable to and detachable from the ejected paper accumulating portion of the main body device, the relay unit including a relay unit inlet that is disposed to face the main body ejection portion and a relay unit outlet that feeds the target material that is fed in through the relay unit inlet, a post-processing unit configured to be attachable to and detachable from an upward exposed surface of the supporting mount and to perform a post-process on the target material ejected from the relay unit outlet, wherein the relay unit is provided with a relay unit connector which is disposed at a side of the relay unit, the side being orthogonal to a direction in which the relay unit is attached to and detached from the ejected paper accumulating portion, wherein the supporting unit, the power unit, the relay unit and the post-processing unit are configured to be independently attachable and detachable elements, respectively, and the supporting unit and the relay unit are configured to be attachable to and detachable from the main body device independently of each other, wherein the supporting unit includes a first connector configured to connect with the relay unit connector provided at the relay unit to supply power for driving the relay unit from the power unit, when the perpendicular wall portion is attached externally to the side surface of the main body device to which the relay unit is attached in a state where the power unit is integrated with the frame body in advance, and wherein the power unit includes an input connector connecting with the main body device through a cable, and a second connector, which is different from the input connector, configured to connect with a post-processing unit connector of the post-processing unit to supply power for driving the post-processing unit from the power unit, when the post-processing unit is attached to the supporting mount of the supporting unit which is attached externally to the side surface of the main body device.

2. The image forming apparatus according to claim 1, wherein the power unit supplies, to the post-processing unit, the power at the second voltage for driving the relay unit or power at a third voltage that is different from the first voltage.

3. The image forming apparatus according to claim 1, wherein a control signal that is output from the main body device in order to control respective operations of the relay unit and the post-processing unit is supplied to the respective units via the first connector and the second connector.

4. The image forming apparatus according to claim 1, wherein the relay unit connector is disposed to extend in a horizontal direction, in a vicinity of the relay unit outlet and the first connector is disposed on a face of the frame body on a main body device side, to extend in the horizontal direction.

5. The image forming apparatus according to claim 1, wherein: the frame body is moved in a horizontal direction when being attached to the main body device;

a connecting part of the relay unit connector is disposed to be directed to the horizontal direction;

a connecting part of the first connector is disposed to be directed in the horizontal direction;

the post-processing unit is moved in a perpendicular direction to be attached to the frame body;

a connecting part of the post-processing unit connector is disposed to be directed in the perpendicular direction; and a connecting part of the second connector is disposed to be directed in the perpendicular direction.

6. The image forming apparatus according to claim 5, wherein the first connector is disposed at a surface of the perpendicular wall portion of the frame body, the surface facing the main body device, and the second connector is disposed at an upward surface of the power unit.

7. The image forming apparatus according to claim 1, wherein the first connector is disposed at the perpendicular wall portion and the relay unit connector is disposed at the relay unit, such that the first connector and the relay unit connector come into alignment and are engaged with each other without a cable, and the second connector is disposed at the power unit and the post-processing unit connector is disposed at the post-processing unit, such that the second connector and the post-processing unit connector come into alignment and are engaged with each other without a cable.

8. The image forming apparatus according to claim 1, wherein a direction in which the supporting unit is attached to and detached from the main body device is orthogonal to a direction in which the relay unit is attached to and detached from the main body device.

9. A post-processing device attached to a main body device on which an image reading device to read an image of a document is provided, the main body device configured to form the image on a target material, the main body device including:

a case member that constitutes an outer shape thereof;

a storage unit that stores the target material and is insertable to and removable from the case member;

a main power supply unit to which power at a first voltage supplied from an external power source is input and which can output power at the first voltage;

an image forming unit that is driven by a first portion of the power at the first voltage supplied from the main power supply unit and that forms an image on the target material;

a main body ejection portion that ejects the target material on which the image is formed by the image forming unit, to an outside of the case member;

an ejected paper accumulating portion which is provided below the image reading device and configured to accommodate the target material ejected from the main body ejection portion, and a main body feeder that feeds the target material stored in the storage unit to the image forming unit and feeds the target material on which the image is formed by the image forming unit to the main body ejection portion, and the post-processing device including:

a supporting unit having a frame body that comprises a perpendicular wall portion extending in a vertical direction and a supporting mount projecting horizontally from the perpendicular wall portion, the supporting unit being attached externally to a side surface of the main body device, a power unit attached to the frame body under the supporting mount of the supporting unit and electrically connected to the main power supply unit to be supplied with a second portion of the power at the first voltage through the main power supply unit, the power unit configured to transform the power thus supplied to a second voltage and to output the transformed power, a relay unit configured to be attachable to and detachable from the ejected paper accumulating portion of the main body device, the relay unit including a relay unit inlet that is disposed to face the main body ejection portion and a relay unit outlet that feeds the target material that is fed in through the relay unit inlet, a post-processing unit configured to be attachable to and detachable from an upward exposed surface of the supporting mount and to perform a post-process on the target material ejected from the relay unit outlet, wherein the relay unit is provided with a relay unit connector which is disposed at a side of the relay unit the side being orthogonal to a direction in which the relay unit is attached to and detached from the ejected paper accumulating portion, wherein the supporting unit, the power unit, the relay unit and the post-processing unit are configured to be independently attachable and detachable elements, respectively, and the supporting unit and the relay unit are configured to be attachable to and detachable from the main body device independently of each other, wherein the supporting unit includes a first connector configured to connect with the relay unit connector provided at the relay unit to supply power for driving the relay unit from the power unit, when the perpendicular wall portion is attached externally to the side surface of the main body device to which the relay unit is attached in a state where the power unit is integrated with the frame body in advance, and wherein the power unit includes an input connector connecting with the main body device through a cable, and a second connector, which is different from the input connector, configured to connect with a post-processing unit connector of the post-processing unit to supply power for driving the post-processing unit from the power unit, when the post-processing unit is attached to the supporting mount of the supporting unit which is attached externally to the side surface of the main body device.

10. The post-processing device according to claim 9, wherein the first connector is disposed at the perpendicular wall portion and the relay unit connector is disposed at the relay unit, such that the first connector and the relay unit connector come into alignment and are engaged with each other without a cable, and the second connector is disposed at the power unit and the post-processing unit connector is disposed at the post-processing unit, such that the second connector and the post-processing unit connector come into alignment and are engaged with each other without a cable.

11. The post-processing device according to claim 9, wherein a direction in which the supporting unit is attached to and detached from the main body device is orthogonal to a direction in which the relay unit is attached to and detached from the main body device.

* * * * *